US010501927B2

(12) United States Patent
Pleasants

(10) Patent No.: US 10,501,927 B2
(45) Date of Patent: Dec. 10, 2019

(54) DRAIN CLEANER WITH DRUM EXCHANGE MECHANISM

(71) Applicant: TTI (MACAO COMMERCIAL OFFSHORE) LIMITED, Macau, MO (US)

(72) Inventor: Parke Pleasants, Anderson, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 316 days.

(21) Appl. No.: 15/478,574

(22) Filed: Apr. 4, 2017

(65) Prior Publication Data

US 2018/0282991 A1 Oct. 4, 2018

(51) Int. Cl.

| | |
|---|---|
| ***E03F 9/00*** | (2006.01) |
| ***B08B 9/045*** | (2006.01) |
| ***B08B 9/047*** | (2006.01) |

(52) U.S. Cl.

CPC ..... *E03F 9/005* (2013.01); *B08B 9/045* (2013.01); *B08B 9/047* (2013.01)

(58) Field of Classification Search

CPC ..... E03F 9/005; B08B 9/045; B08B 9/047
See application file for complete search history.

(56) References Cited

U.S. PATENT DOCUMENTS

| | | | | |
|---|---|---|---|---|
| 3,691,583 | A | 9/1972 | Silverman | |
| 3,703,015 | A | 11/1972 | Naeve | |
| 4,364,139 | A | 12/1982 | Babb | |
| 4,700,422 | A | 10/1987 | Russell | |
| 4,773,113 | A | 9/1988 | Russell | |
| 4,914,775 | A | 4/1990 | Kirk | |
| 4,916,772 | A | 4/1990 | Russell | |
| 4,956,889 | A | 9/1990 | Kirk | |
| 5,031,276 | A | 7/1991 | Babb | |
| 5,193,242 | A * | 3/1993 | Irwin | B08B 9/045 15/104.31 |
| 5,309,595 | A | 5/1994 | Salecker | |
| 6,618,891 | B2 | 9/2003 | Schmitt | |
| 6,618,892 | B2 | 9/2003 | Schmitt | |
| 6,760,948 | B2 | 7/2004 | Schmitt | |

FOREIGN PATENT DOCUMENTS

EP 0065474 A1 * 11/1982 ..... E03F 9/005

OTHER PUBLICATIONS

European Patent Office Search Report for Application No. 18165555.6 dated Sep. 7, 2018, 9 pages.

* cited by examiner

*Primary Examiner* — Shay Karls
(74) *Attorney, Agent, or Firm* — Michael Best & Friedrich LLP

(57) ABSTRACT

A drain cleaner including a rotatable drum, a cable at least partially housed within the drum, and a body supporting the drum. The body includes a first housing and a second housing. The first housing and the second housing are movable relative to one another between a closed position, in which the drum is secured to the body, and an open position, in which the drum is removable from the body.

18 Claims, 12 Drawing Sheets

DRAIN CLEANER WITH DRUM EXCHANGE MECHANISM

FIELD OF INVENTION

The present invention relates to drain cleaners, and specifically, drain cleaners with removable drums.

BACKGROUND

Drain cleaners are used to clean dirt and debris out of drains or other conduits that collect debris in locations that are difficult to access. Drain cleaners typically have a cable or snake that is inserted into the drain to collect the debris. Some cables are manually fed into the drain, while others are driven into the drain by a motor.

Overtime, the cable may become worn and may need to be replaced. Alternatively, even when the cable is in good condition, a user may want to replace the cable with a different type of cable. For example, a cable of a different width, length, or texture may be desired. Changing the cable can be cumbersome and often requires a user to disassemble portions of the drain cleaner, which can be time consuming or require the use of tools.

SUMMARY

In one embodiment, the invention provides a drain cleaner including a rotatable drum, a cable at least partially housed within the drum, and a body supporting the drum. The body includes a first housing and a second housing that are movable relative to one another between a closed position, in which the drum is secured to the body, and an open position, in which the drum is removable from the body.

In another embodiment, the invention provides a drain cleaner including a rotatable drum, a cable at least partially housed within the drum, and a body supporting the drum. The body includes a first housing and a second housing. The first housing and the second housing are movable relative to one another between a closed position, in which the drum is secured to the body, and an open position, in which the drum is removable from the body. A drum release mechanism is disposed on the first housing and the second housing to control relative movement of the first housing and the second housing.

In yet another embodiment, the invention provides a drain cleaner including a rotatable drum, a cable at least partially housed within the drum, and a body supporting the drum. The body includes a first housing and a second housing that are movable relative to one another between a closed position, in which the drum is secured to the body, and an open position, in which the drum is removable from the body. A drum release mechanism is disposed on one of the first housing and the second housing selectively lock and unlock the body. The first housing is movable relative to the second housing when the body is unlocked, and the first housing is fixed relative to the second housing when the body is locked. The drum release mechanism includes a latch positioned on one of the first housing and the second housing, where the latch is configured to selectively engage the other of the first housing, and the second housing, and an actuator actuable to disengage the latch from the other of the first housing and the second housing.

Other aspects of the invention will e apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
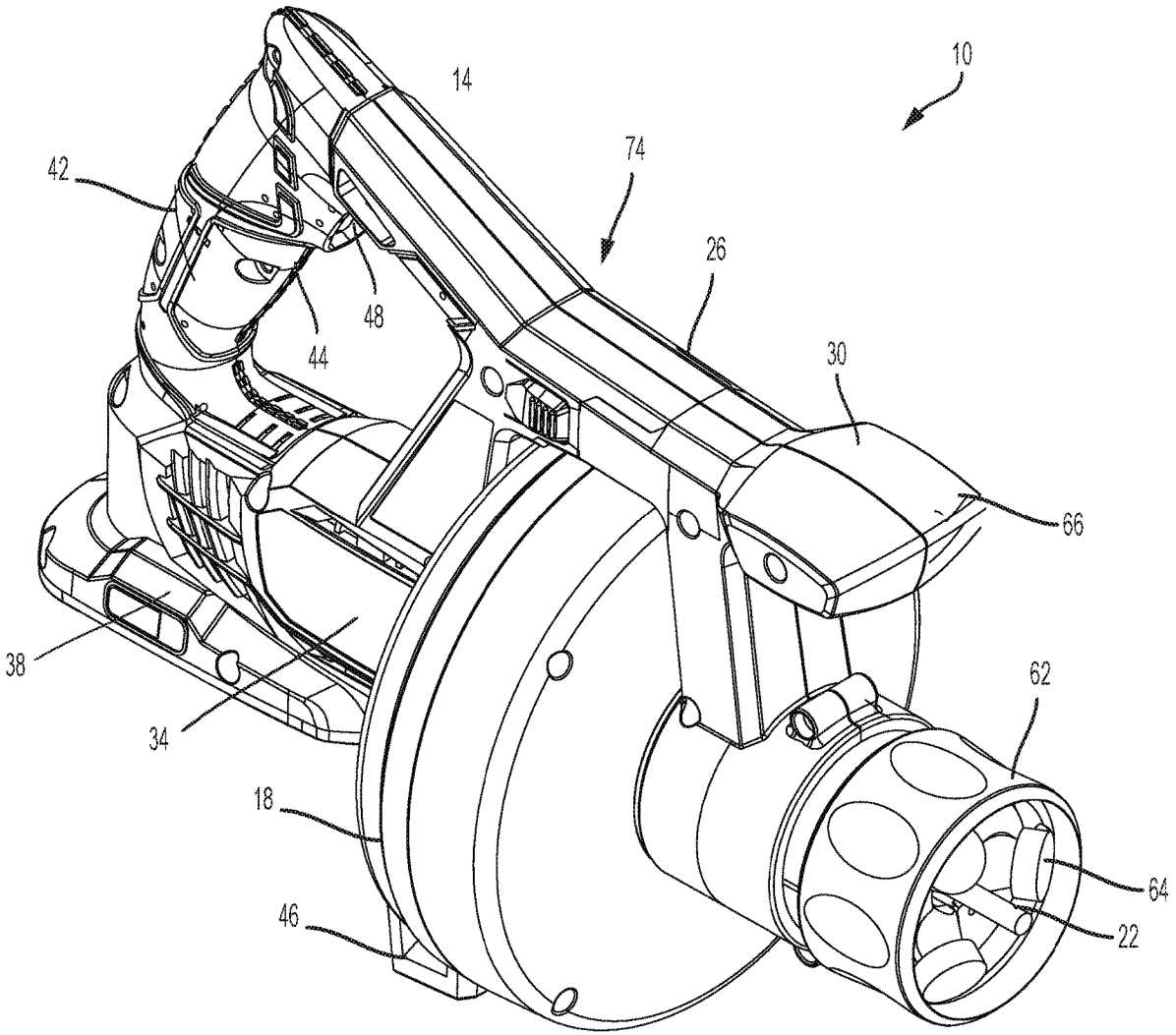
FIG. 1 is a perspective view of a drain cleaner according to one embodiment of the invention.
Figure 2:
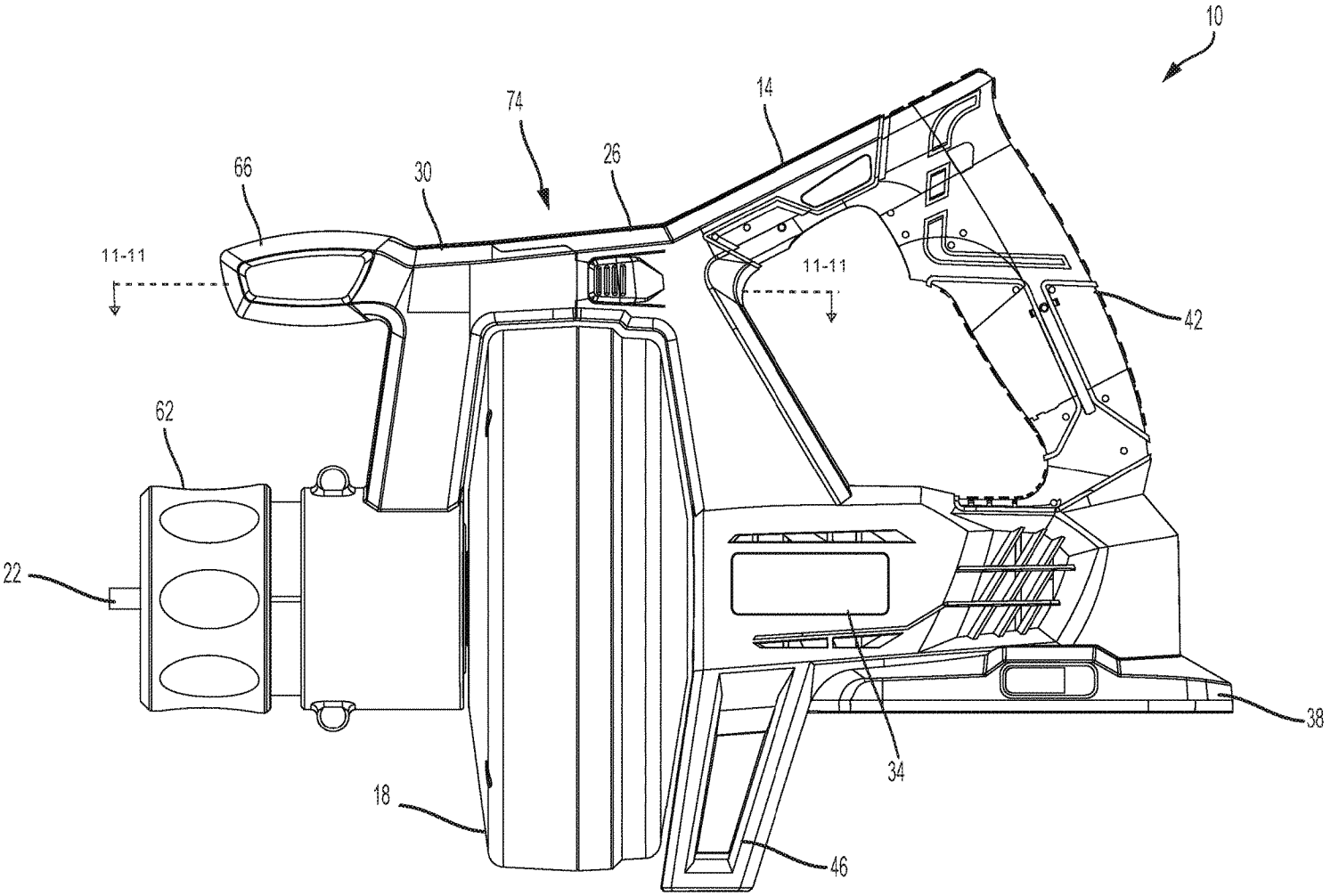
FIG. 2 is a side view of the drain cleaner of FIG. 1.

FIGS. 1-2 illustrate a drain cleaner 10 according to one embodiment of the invention. The drain cleaner 10 includes a body 14 and a drum 18 rotatably supported by the body 14. A flexible cable 22 is stored within the drum 18 and extends through a portion of the body 14. The cable 22 is insertable into a drain, or other conduit, for cleaning the drain. Rotation of the drum 18 results in rotation of the cable 22. Specifically, in the illustrated embodiment, friction between the inner surface of the drum 18 and the cable 22 causes the cable 22 to rotate or spin with the drum 18. Rotation of the cable 22 helps break up and collect debris within the drain.

The body 14 includes a first housing 26 and a second housing 30. In the illustrated embodiment, the drum 18 is disposed between the first housing 26 and the second housing 30. The first housing 26 includes a motor compartment 34, a battery receptacle 38, a handle assembly 42, and a stand 46. The motor compartment 34 houses at least a portion of a motor (not shown) and a drive mechanism for rotating the drum 18.

Figure 4:
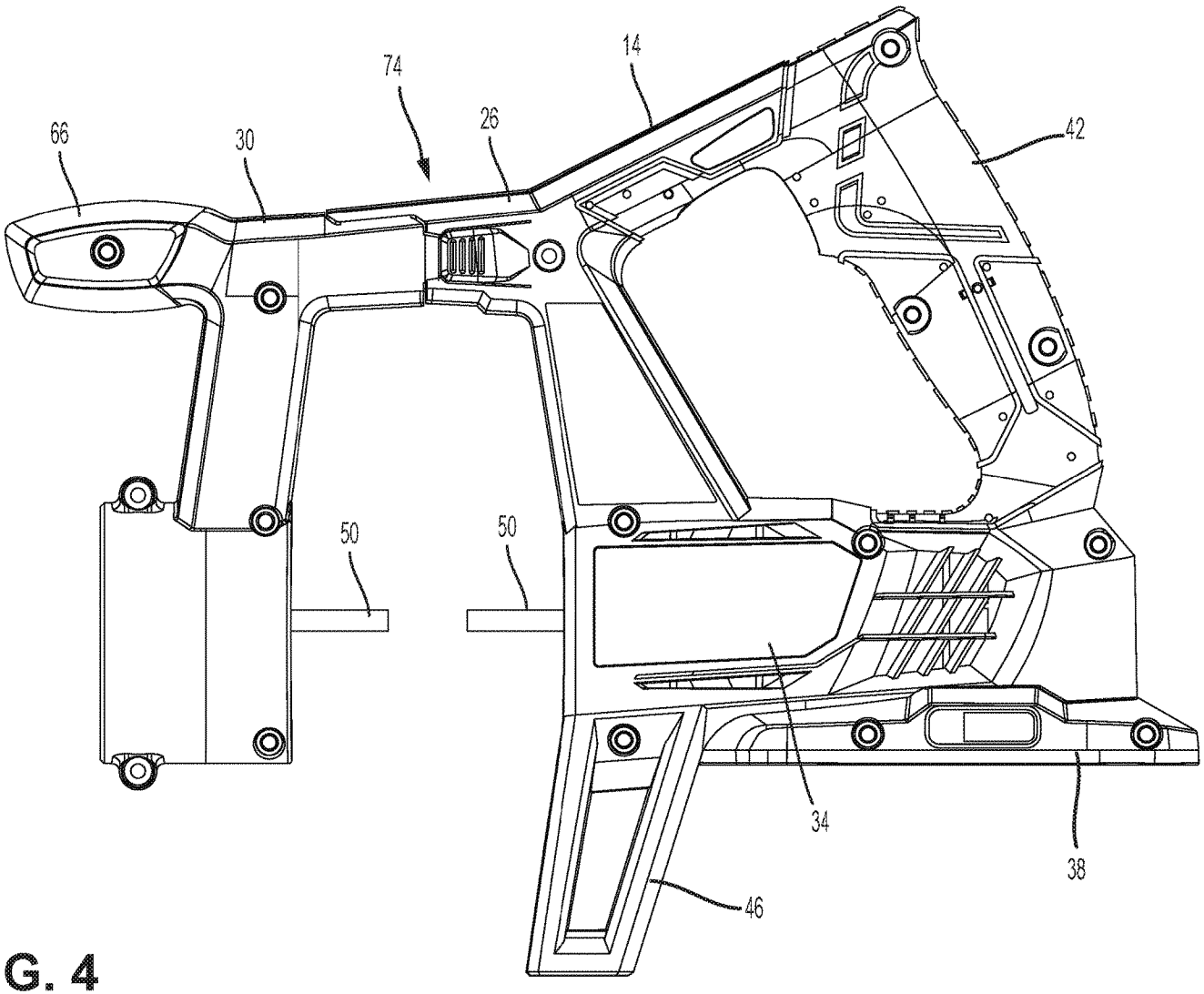
FIG. 4 a perspective view of the drain cleaner of FIG. 1 with the body in an open position.

The drum 18 is coupled to the drive mechanism such that rotation of the motor is transmitted to the drum 18 through the drive mechanism. The drive mechanism can include any suitable means to transmit force (e.g., rotation) from the motor to the drum 18. For example, in the illustrated embodiment, the drive mechanism includes a shaft 50 (FIG. 4) that transmits rotational force of the motor to the drum 18 to rotate the drum 18. The rotational force is then transmitted to the cable 22 to rotate the cable 22 within the drain.

The motor is powered by a battery pack (not shown) that is at least partially housed in the battery receptacle 38. The battery receptacle 38 receives and supports the battery pack, and includes terminals that electrically connect the battery pack to the motor. In other embodiments, the handle assembly 42 may support a power cord to electrically connect the motor to an AC power source.

The handle assembly 42 extends rearwardly from the drum 18, and is disposed above the motor compartment 34 and the battery receptacle 38. The handle assembly 42 includes a grip 44 that is configured to be grasped by a user for carrying and operating the drain cleaner 10. The handle assembly 42 supports a trigger 48 adjacent the grip 44. The trigger 48 is actuatable (e.g., depressible) by a user to selectively energize the motor and, thereby, operate the drain cleaner 10.

When the drain cleaner 10 becomes cumbersome to use or is not being operated, a user can rest the drain cleaner 10 on a surface with the help of the stand 46. The stand 46 engages and rests on a support surface (e.g., a table, a workbench, a countertop, the floor, etc.) to provide ease of use during operation or when the drain cleaner 10 is not in use. The stand 46 is positioned generally beneath the motor compartment 34. More particularly, the stand 46 is positioned beneath a center of gravity of the drain cleaner 10. In one embodiment, the attached battery pack aligns with the stand 46 to help support the drain cleaner 10.

The second housing 30 extends forwardly of the drum 18. The second housing 30 includes a feed mechanism 62 and a pommel handle 66. The feed mechanism 62 drives linear movement of the cable 22 into and out of the drain. In the illustrated embodiment, the feed mechanism 62 includes rollers 64 that engage the cable 22 to drive the cable 22 in a linear direction. The pommel handle 66 provides the user with additional control of the drain cleaner 10 during operation.

Figure 3:
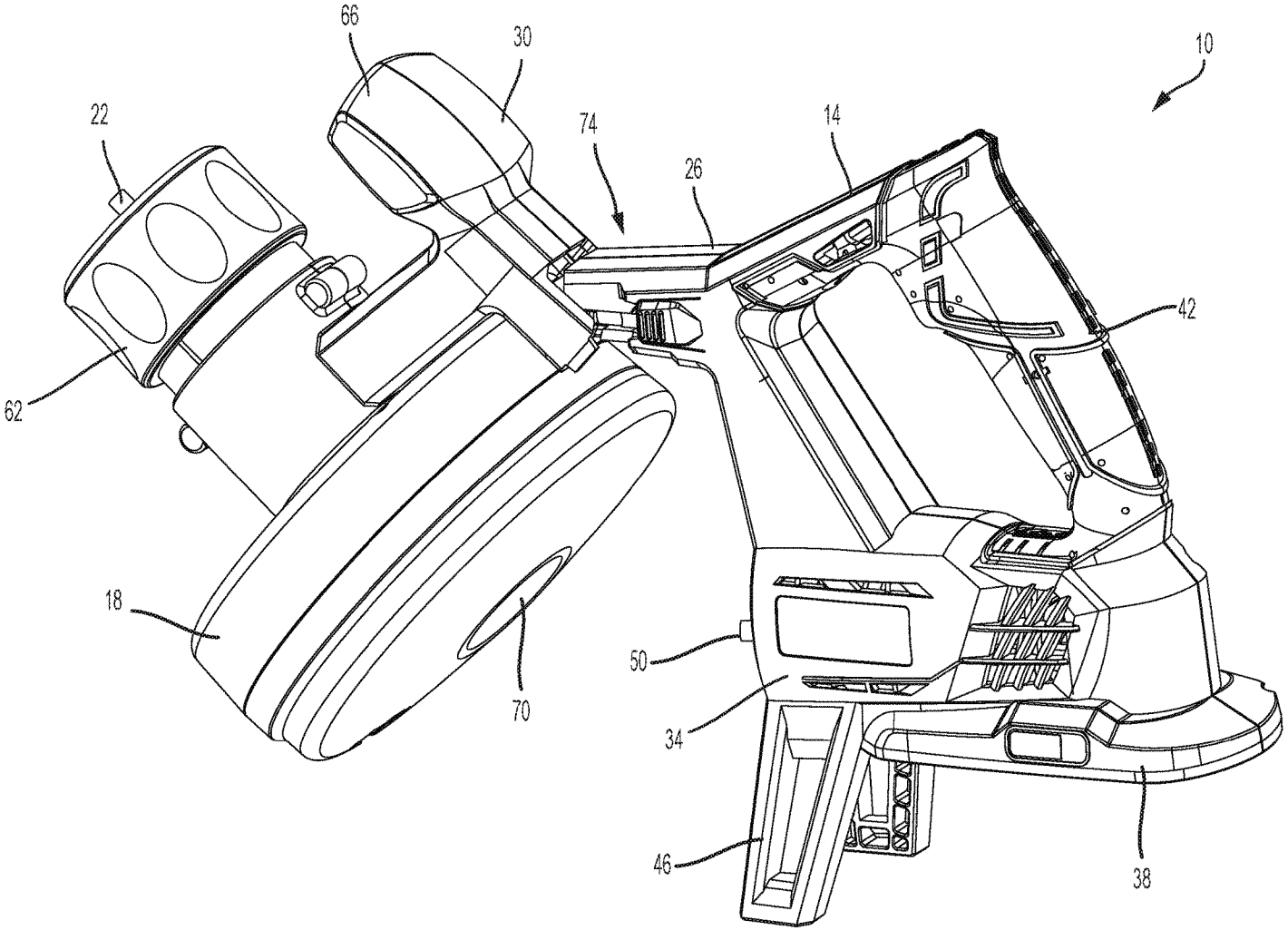
FIG. 3 is a side view of the drain cleaner of FIG. 1 with the drum removed.

The drum 18 is rotatably supported between the first housing 26 and the second housing 30. Specifically, the drum 18 is supported by the shaft 50 (FIG. 3) that extends through an opening 70 in the drum 18, where the opening 70 is aligned with the axis of rotation of the drum 18. FIG. 3 illustrates the body 14 with the drum 18 removed to reveal the shaft 50. In the illustrated embodiment, both the first housing 26 and the second housing 30 include a portion of the shaft 50 to support the drum 18. In other embodiments, only one of the housings includes the shaft 50. The shaft 50 does not extend continuously through the drum 18 in order to allow the drum 18 to be removed from the body 14 without interference from the shaft 50.

When the cable 22 inside the drum 18 becomes worn or a different style of cable 22 is desired, a user can remove the drum 18 and replace the drum 18 with a new drum 18. The drum 18 can be replaced with an entirely new drum 18, for example, a drum 18 with a cable 22 of a different type or length. Alternatively, if the cable 22 breaks, the drum 18 can also be removed so that a new cable 22 can be inserted into the drum 18 and then the same drum 18 placed back into the drain cleaner 10. The drum 18 and cable 22 of the illustrated drain cleaner 10 are removed and replaced without the use of tools. On occasion the cable 22 can become worn or even break during operation of the drain cleaner 10. Rather than removing the drum 18 through cumbersome methods or with the assistance of tools, a user can quickly and efficiently remove and replace the drum 18 and then continue operation. In other situations, a different cable 22 may be desired that is more suitable for a given situation. For example, a user may wish to replace the drum 18 with a different drum 18 carrying a cable of a different length, width, or other characteristic.

The drum 18 is removed from the body 14 by moving the first housing 26 and the second housing 30 relative to one another. The first housing 26 and the second housing 30 are movable relative to one another between a closed position, in which the drum 18 is secured to the body 14, and an open position in which the drum 18 can be removed from the body 14. FIGS. 1-2 illustrate the housings 26, 30 in a closed position. FIG. 3 illustrates the second housing 30 rotated upward to an open position, which allows the drum 18 to be removed. In order to move the drain cleaner 10 between an open position and a closed position, the body 14 must first be unlocked. The drain cleaner 10 includes a release mechanism 74 that can selectively lock and unlock the body 14 to restrict or allow relative movement of the first housing 26 and the second housing 30.

Figure 5:
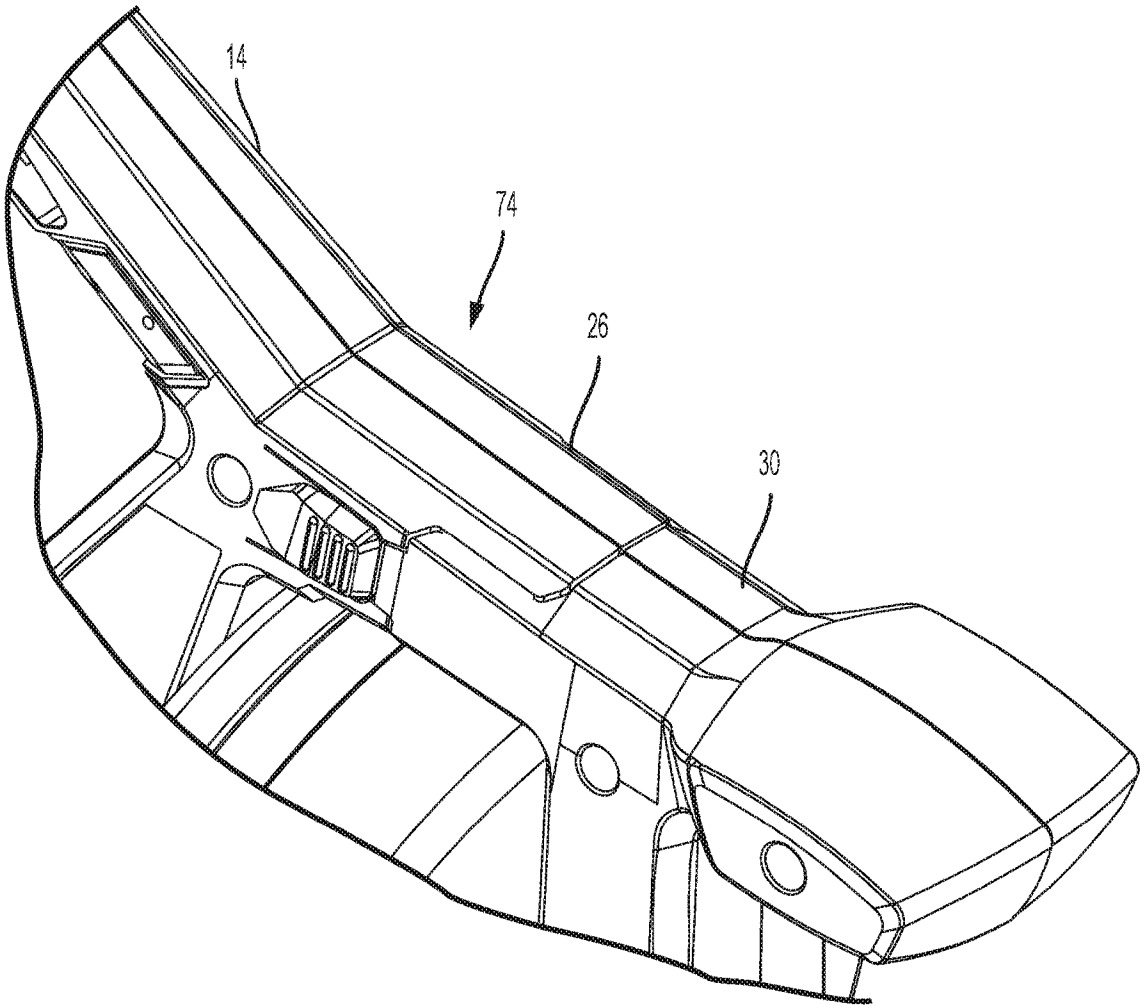
FIG. 5 is a detailed view of a drain cleaner release mechanism in a closed position.
Figure 6:
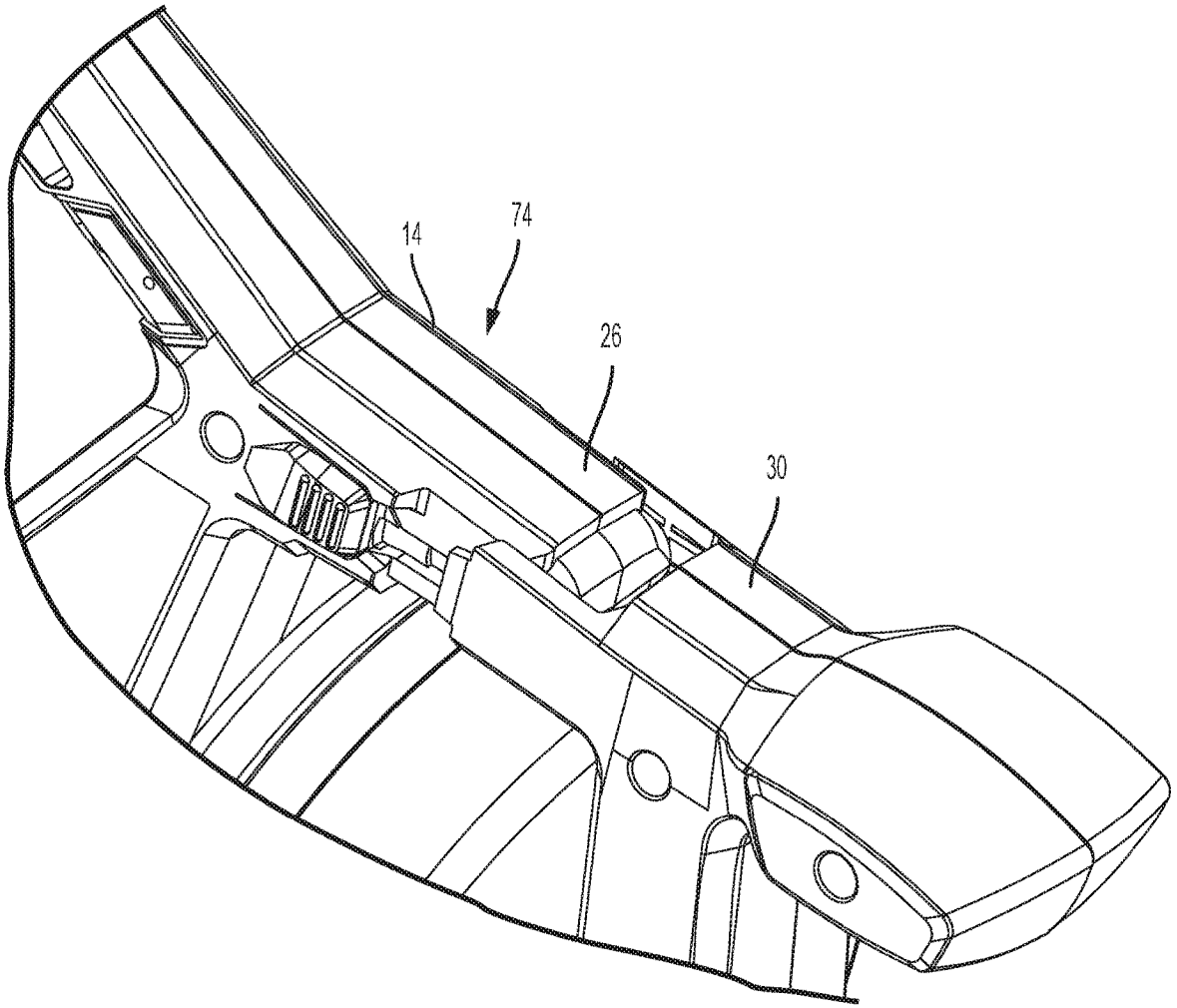
FIG. 6 is a detailed view of the drain cleaner release mechanism in an intermediate position.
Figure 7:
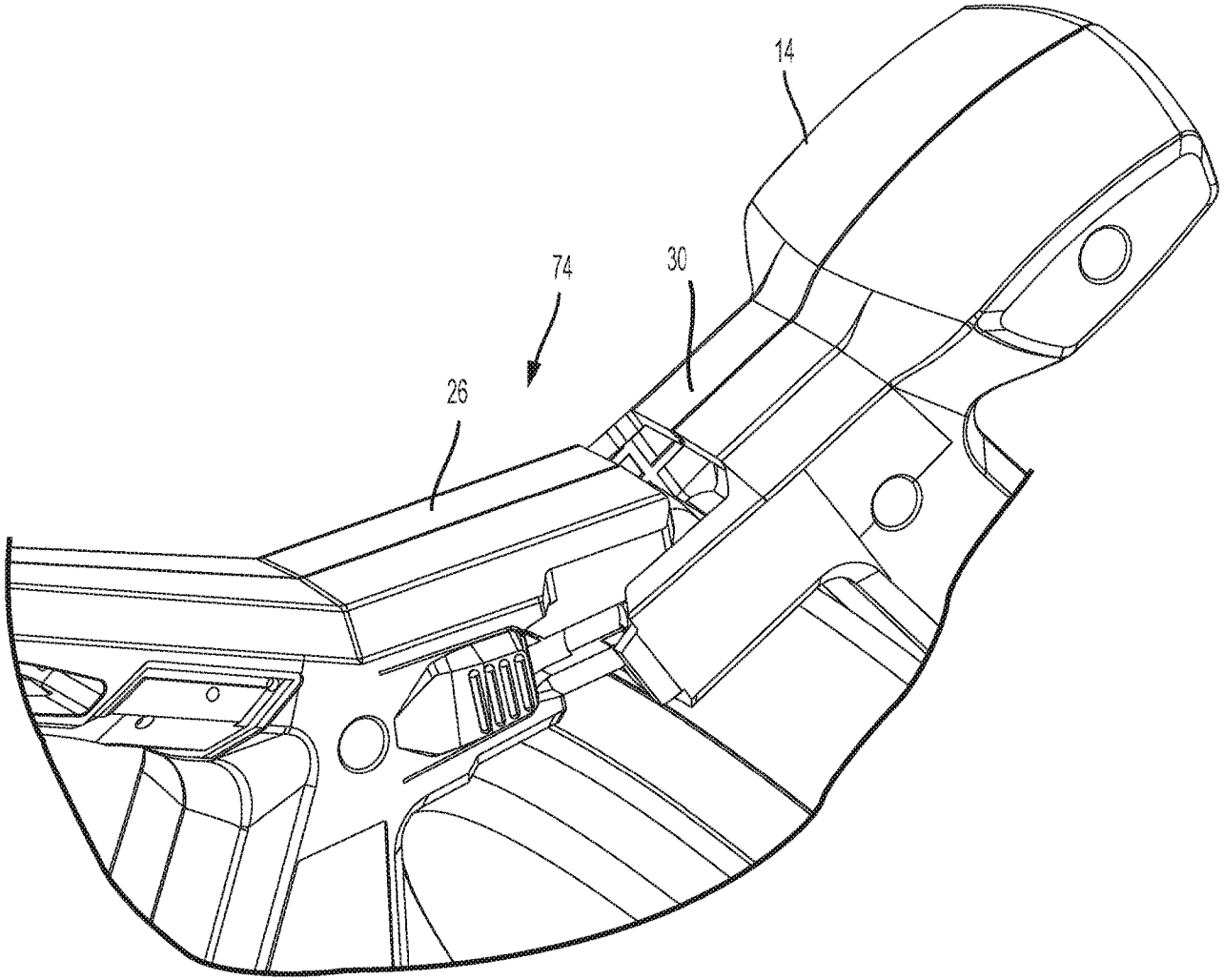
FIG. 7 is a detailed view of the drain cleaner release mechanism in an open position.

With reference to FIGS. 5-7, the drain cleaner 10 is adjustable to three discrete positions: the first position ("the closed position") in which the drain cleaner 10 is locked and closed; the second position ("the intermediate position") in which the drain cleaner 10 is unlocked but remains closed; and the third position ("the open position") in which the drain cleaner 10 is unlocked and open.

More specifically, when in the drain cleaner is in the first position ("the closed position"), shown in FIG. 5, the release mechanism 74 is locked and the body 14 is closed. That is, the body 14 is closed with the first housing 26 and the second housing 30 rotated towards one another to secure the drum 18 therebetween. In addition, the release mechanism 74 is locked to prevent movement of the first housing 26 relative to the second housing 30.

When in the second position (i.e., "the intermediate position"), shown in FIG. 6, the release mechanism 74 is unlocked and the body 14 remains closed. The second position is a discrete position between the open position and the closed position in which the release mechanism 74 is moved to an unlocked position. When the release mechanism 74 is in the unlocked position, the first housing 26 and the second housing 30 are capable of moving relative to one another. However, when the drain cleaner 10 is in the intermediate position, the body 14 continues to remain in a closed position with the first housing 26 and the second housing 30 rotated towards one another. In other words, although the first housing 26 and the second housing 30 are movable relative to one another, the second housing 30 has not yet been rotated away from the first housing 26.

To arrive at the intermediate position from the closed position, the release mechanism 74 is engaged and the first housing 26 and the second housing 30 are slide relative to one another to move the release mechanism 74 into an unlocked position. More specifically, when the release mechanism 74 is engaged, the first housing 26 and the second housing 30 are slidable relative to one another. When the release mechanism 74 is disengaged, the first housing 26 and the second housing 30 cannot slide relative to one another. For example, as will be explained in greater detail below, in one embodiment, the release mechanism is engaged by pressing a button (i.e., and actuator 110). While the release mechanism is engaged (i.e., the actuator 110 is pressed), the first housing 26 and the second housing 30 are slide apart from one another to move the release mechanism towards the unlocked position. Once the first housing 26 and the second housing 30 are slide away from one another, the release mechanism 74 is disengaged the actuator 110 is released) leaving the release mechanism 74 in the unlocked position. When the release mechanism 74 is in the unlocked position, the first housing 26 and second housing 30 are freely rotatable relative to one another. In other words, when in the unlocked position, the release mechanism 74 no longer prevents rotational movement of the first housing 26 relative to the second housing 30.

In the third position "the open position"), shown in FIG. 7, the release mechanism 74 remains in the unlocked position, and the body 14 is moved to the open position. Specifically, the second housing 30 is rotated upward and away from the first housing 26, allowing the drum 18 to be removed. The drum 18 can be slid off of the shaft 50 and a new drum 18 slid on.

In some embodiments, the drain cleaner 10 does not include an intermediate position. Rather, the drain cleaner 10 can move directly from the first position, in which the release mechanism is locked and the body is in the closed position, to the third position, in which the release mechanism is unlocked and the body is in the open position.

The adjustment of the drain cleaner 10 between the different positions is made possible by the release mechanism 74. FIGS. 8-12 illustrate detailed views of the release mechanism 74. Some components of the release mechanism 74 are disposed on the first housing 26 and some components are disposed on the second housing 30. It should be understood by a person of ordinary skill in the art that although certain components are described as being positioned on one of the housings, in other embodiments the components can be positioned on the opposite housing.

Figure 8:
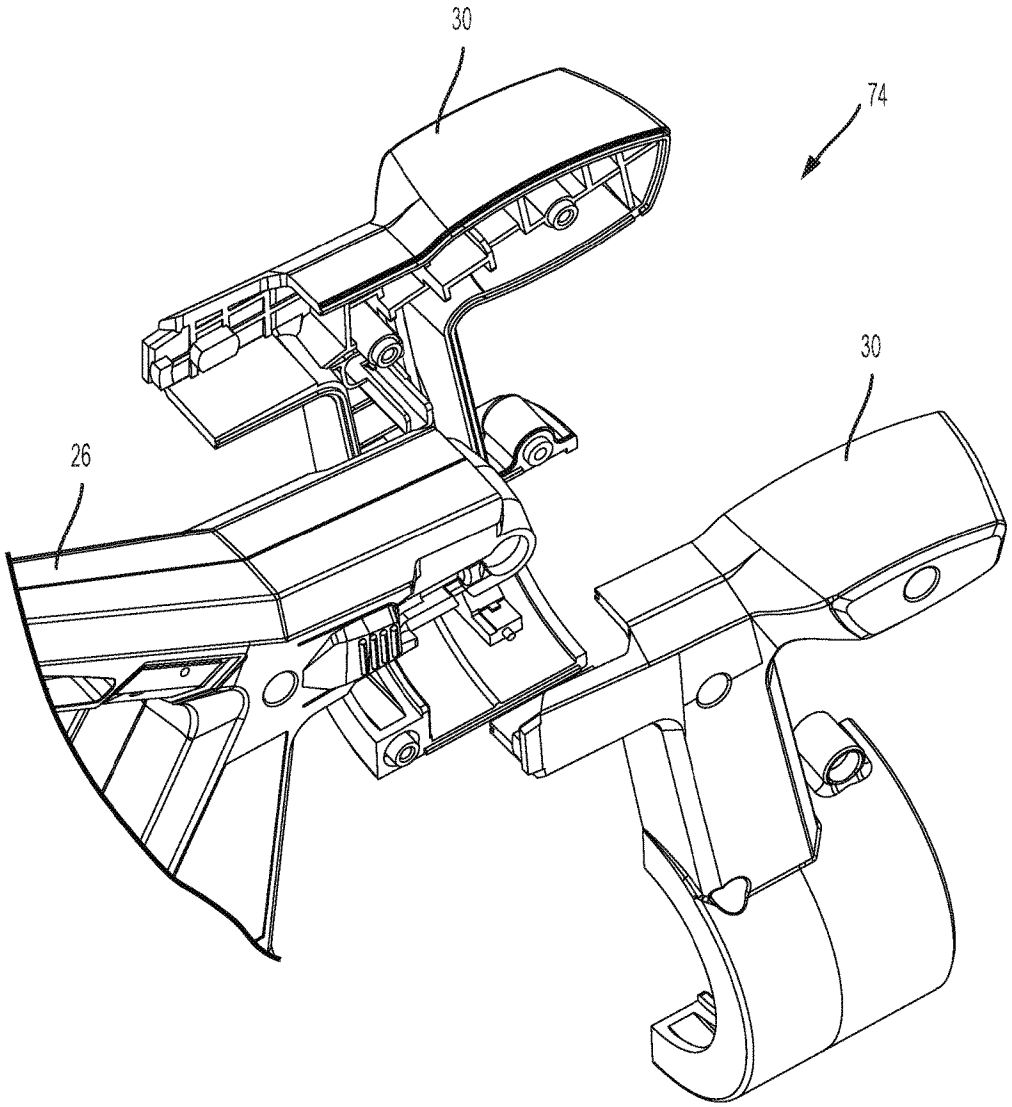
FIG. 8 is an exploded view of the release mechanism of the drain cleaner according to one embodiment of the invention.
Figure 9:
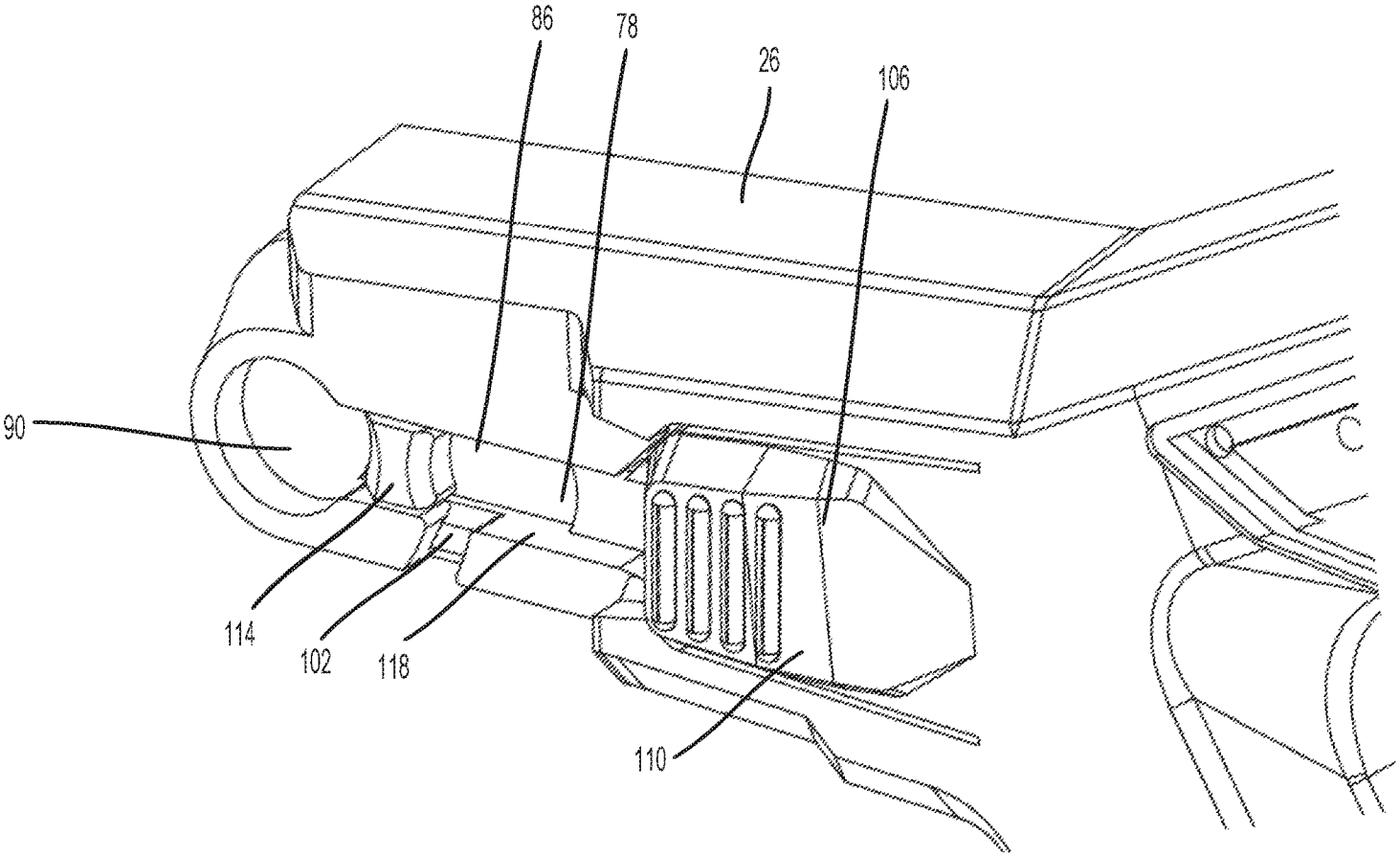
FIG. 9 illustrates a portion of the release mechanism on the first housing.
Figure 10:
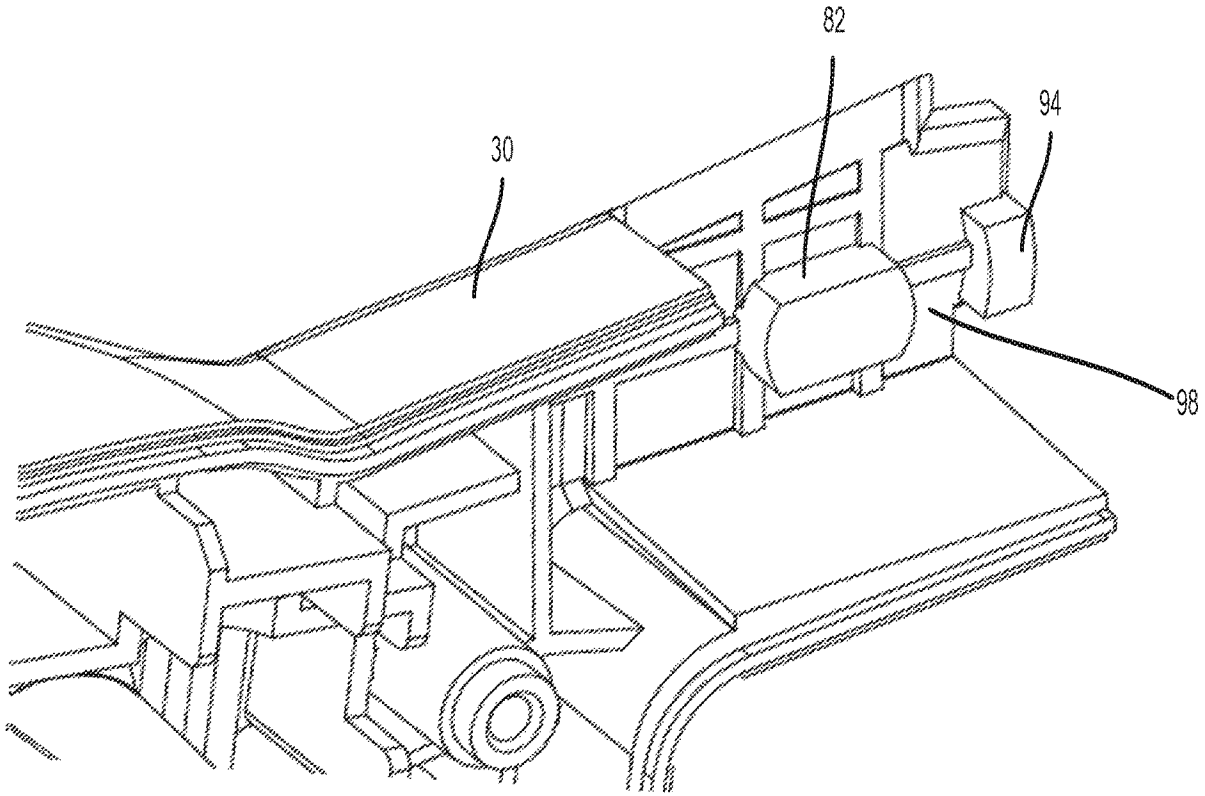
FIG. 10 illustrates a portion of the release mechanism on the second housing.

Referring to FIGS. 8-10, the release mechanism 74 includes a channel 78 disposed on the first housing 26 and a protrusion 82 disposed on the second housing 30. The protrusion 82 is movable within the channel 78. Specifically, the channel 78 includes a linear portion 86 and a circular portion 90. Accordingly, the protrusion 82 moves in a linear direction within the linear portion 86 of the channel 78 and the protrusion 82 moves in a rotational direction within the circular portion 90 of the channel 78. In the illustrated embodiment, the protrusion 82 is shaped to help facilitate linear and rotational movement within the respective portions of the channel 78. Specifically, the protrusion 82 has flat edges along the top and bottom to engage with the walls 118 of the channel 78 in the linear portion 86. In addition, the left and right edges of the protrusion 82 are rounded to align with the circular portion 90 of the channel 78 to help facilitate rotational movement. However, in other embodiments the protrusion 82 can have other shapes and sizes.

With continued reference to FIGS. 8-10, the second housing 30 also includes a stopper 94 aligned with the protrusion 82 so that the stopper 94 slides within the channel 78 with the protrusion 82. The stopper 94 is spaced apart from the protrusion 82 to leave a space 98 between the stopper 94 and the protrusion 82. When the release mechanism 74 is in the locked position, the stopper 94 limits movement of the first housing 26 relative to the second housing 30 by engaging with the channel walls 118, which prevent movement of the stopper 94 in a second direction 84 and only allow movement along the first direction 80 (i.e., the direction of the channel 78). Accordingly, the second housing 30 can slide relative to the first housing 26, but cannot rotate relative to the first housing 26.

Sliding the first housing 26 and the second housing 30 away from one another moves the release mechanism 74 into the unlocked position. When the release mechanism 74 is in the unlocked position, the stopper 94 permits rotational movement of the second housing 30 with respect to the first housing 26. In particular, when the first housing 26 and second housing 30 are slide into the unlocked position, the protrusion 82 is aligned within the circular portion 90 of the channel 78 and the stopper 94 is aligned with a recess 102 in the wall 118 of the channel 78. Once the stopper 94 is aligned with the recess 102, the channel walls 118 no longer engage with the stopper 94 to prevent movement in the second direction 84. Therefore, the protrusion 82 can rotate within the circular portion 90 and the stopper 94 can slide through the recess 102 in the channel wall 118 to allow the second housing 30 to be rotated. In the illustrated embodiment, only the lower channel wall 118 includes a recess 102. Thus, the second housing 30 only rotates in one direction. In other embodiments, the channel 78 may have a recess 102 that extends through both the upper and the lower channel walls 118 in order to allow rotational movement of the second housing 30 in two directions.

The release mechanism 74 further includes a locking mechanism 106 that prevents or allows relative movement of the first housing 26 and the second housing 30 between the locked position and the unlocked position. The locking mechanism 106 includes an actuator 110 and a latch 114. When the release mechanism 74 is in the locked position, the latch 114 extends into the channel 78 and engages with one or both of the protrusion 82 and the stopper 94 to prevent movement of the protrusion 82 and the stopper 94 along the first direction 80 within the channel 78. By extending into the channel 78, the latch 114 blocks the protrusion 82 from sliding along the linear portion 86 of the channel 78, and thereby prevents the second housing 30 from sliding into the unlocked position. The actuator 110 is engagable to retract the latch 114 from the channel 78 and thereby unlock the drain cleaner 10. In the illustrated embodiment, the actuator 110 is a button that is coupled directly to the latch 114 by an elongated arm. The button is pressed inwardly (i.e., engaged) to retract the latch 114 and release the latch 114 from the protrusion 82. In other embodiments, the actuator 110 may instead be a trigger or a slidable member. Likewise, in other embodiments, the actuator 110 may not be directly coupled to the latch 114, but may be indirectly coupled to the latch 114 through additional components.

Figure 11:
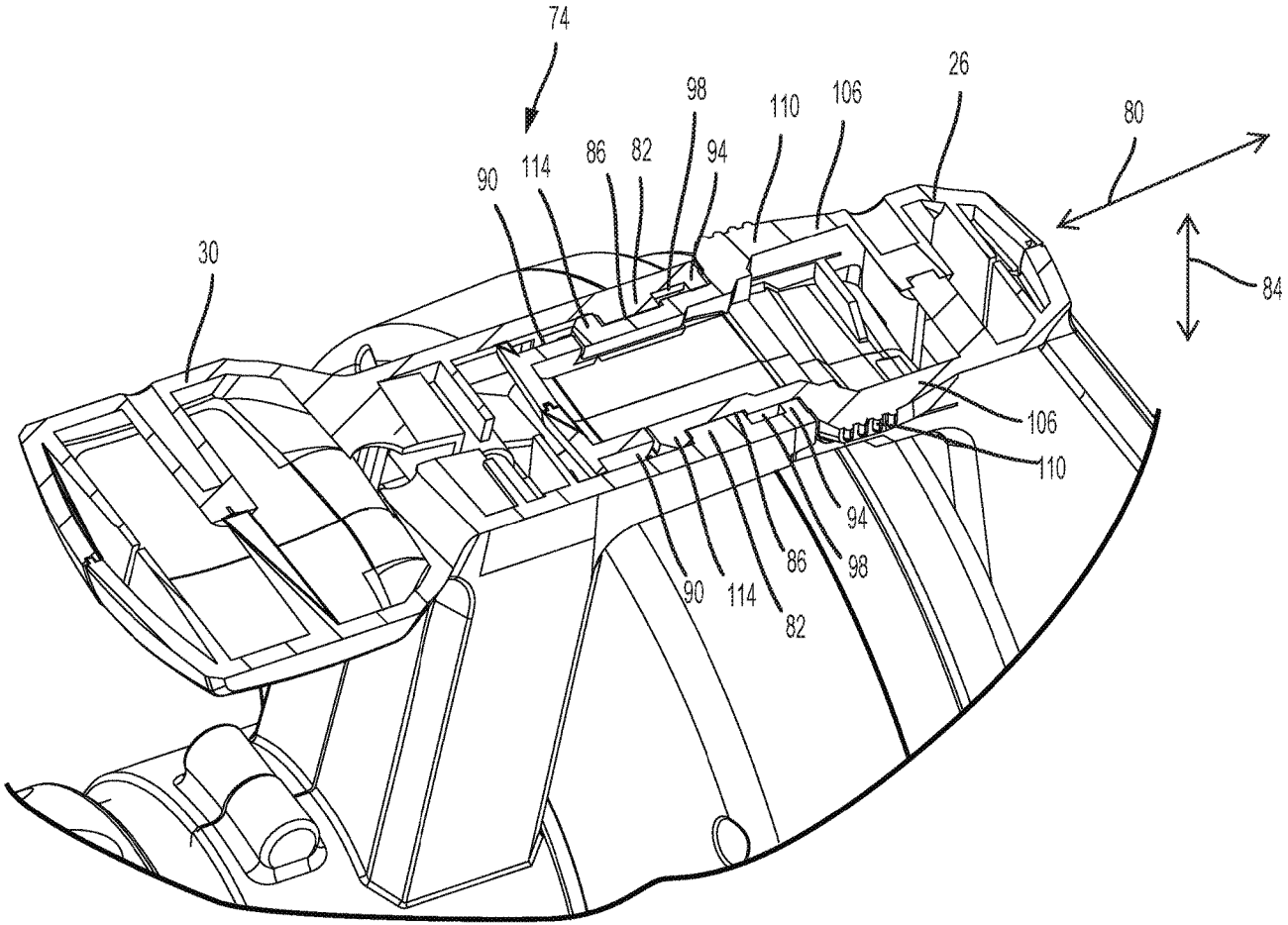
FIG. 11 is a cross-sectional view of the release mechanism in the locked position taken from section line 11-11 of FIG. 2.
Figure 12:
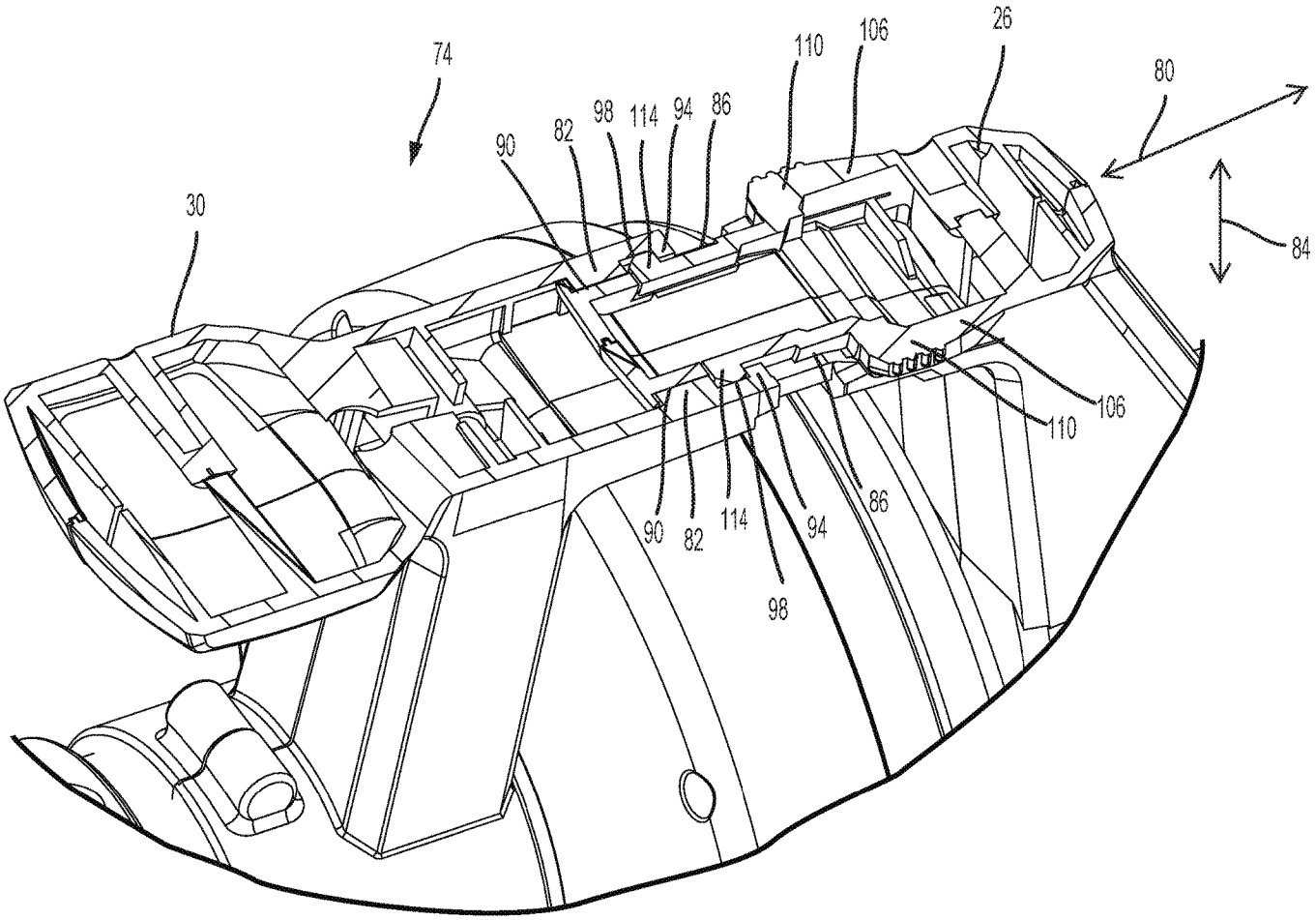
FIG. 12 is a cross-sectional view of the release mechanism in the locked position taken from section line 11-11 of FIG. 2.

In operation, the release mechanism 74 allows the first housing 26 and the second housing 30 of drain cleaner 10 to be moved between the closed position, the intermediate position, and the open position in order to remove and replace the drum 18. FIG. 11 illustrates a cross section of the drain cleaner 10 in the closed position, in which the body 14 is closed and the release mechanism 74 is locked. When in the closed position, the first housing 26 and the second housing 30 are slide towards one another. Both the protrusion 82 and the stopper 94 are positioned within the linear portion 86 of the channel 78. The latch 114 is extended into the channel 78 and is disposed between the protrusion 82 and the circular portion 90 of the channel 78. Accordingly, the latch 114 prevents movement of the protrusion 82 along a first direction 80 towards the circular portion 90 of the channel 78, and thus prevents the second housing 30 from sliding relative to the first housing 26.

To move the drain cleaner 10 from the closed position to the intermediate position, the release mechanism 74 is moved to an unlocked position with the first housing 26 and the second housing 30 slide apart from one another. To do this, the release mechanism 74 is engaged by pressing the actuator 110 inwardly. When the actuator 110 is pressed, the latch 114 is retracted from within the channel 78. While continuing to engage the actuator 110, the user slides the second housing 30 away from the first housing 26. Once the first housing 26 and second housing 30 are slide away from one another, the user may disengage the actuator 110. The release mechanism 74 is now unlocked such that the first housing 26 and the second housing 30 can move freely relative to one another. In the unlocked position, the protrusion 82 is disposed within the circular portion 90 of the channel 78. Further the stopper 94 is disposed within the linear portion 86 of the channel 78 and is aligned with the recess 102 in the channel wall 118. Once the actuator 110 is disengaged, the latch 114 extends into the channel 78. Specifically, the latch 114 is positioned between the protrusion 82 and the stopper 94 with the space 98. Accordingly, the latch 114 prevents movement of the protrusion 82 and the stopper 94 along the first direction 80 to fix the drain cleaner 10 in the unlocked position.

As previously mentioned, because the stopper 94 is aligned with the recess 102 in the channel wall 118, the channel wall 118 does not prevent movement of the stopper 94 in the second direction 84. Therefore, the second housing 30 can be rotated relative to the first housing 26 to arrive at the open position. Specifically, the protrusion 82 rotates within the circular portion 90 of the channel 78 and the stopper 94 moves through the recess 102 in the linear portion 86 of the channel 78. Once in the open position, the drum 18 can be slid off of the shaft 50 and replaced by a new drum 18. To secure the new drum 18 to the body 14, the second housing 30 is rotated back to the intermediate position and then slid towards the first housing 26 to lock the drain cleaner 10 in the closed position.

The release mechanism 74 provides a method of removing and replacing the drum 18 of a drain cleaner 10 without the use of tools, which allows the drum 18 to be replaced quickly and efficiently, and enables a user to replace the drum 18 at a worksite. When a user is using the drain cleaner 10 and the current cable 22 become worn or breaks entirely, the user can exchange the drum 18 for a drum 18 with a new cable 22 without interrupting his work schedule. In addition, if a cable 22 with different characteristics is desired, such as a longer cable 22 or a cable 22 with a different texture or girth, the user can easily exchange the drum 18 to a drum with the preferred cable 22.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A drain cleaner comprising:

a rotatable drum;

a cable at least partially housed within the drum; and a body supporting the drum, wherein the body includes a first housing and a second housing movable relative to one another between a closed position, in which the drum is secured to the body, and an open position, in which the drum is removable from the body, wherein the second housing is slidable away from the first housing to move the body from the closed position to an intermediate position, and wherein the second housing is rotatable relative to the first housing to move the body from the intermediate position to the open position.

2. The drain cleaner of claim 1, wherein drum is positioned between the first housing and the second housing of the body when the body is in a closed position.

3. The drain cleaner of claim 1, wherein the first housing includes a motor and the second housing includes a cable feed mechanism.

4. The drain cleaner of claim 1, wherein the first housing includes a channel and the second housing includes a projection, the projection movable within the channel as the second housing moves relative to the first housing.

5. The drain cleaner of claim 4, wherein the channel includes a linear portion and a circular portion, the projection configured to slide within the linear portion and the projection configured to rotate within the circular portion.

6. The drain cleaner of claim 5, wherein the second housing includes a stopper, the stopper configured to slide within the channel with the projection and the stopper engagable with a wall of the channel to prevent rotational movement of the second housing with respect to the first housing.

7. The drain cleaner of claim 6, wherein the first housing includes a recess formed in the wall adjacent the channel, and wherein the second housing is rotatable relative to the first housing when the stopper is aligned with the recess.

8. A drain cleaner comprising:

a rotatable drum;

a cable at least partially housed within the drum;

a body supporting the drum, the body including a first housing and a second housing, the first housing and the second housing movable relative to one another between a closed position, in which the drum is secured to the body, and an open position, in which the drum is removable from the body; and a release mechanism disposed on the first housing and the second housing to control relative movement of the first housing and the second housing, wherein the first housing includes a handle assembly extending rearwardly from the drum, the handle assembly having a grip and a trigger adjacent the grip, wherein the second housing extends forwardly from the drum and includes a cable feed mechanism, and wherein the drum is rotatably supported between the first housing and the second housing.

9. The drain cleaner of claim 8, wherein the release mechanism is actuable to selectively lock and unlock the body, wherein the first housing is movable relative to the second housing when the body is unlocked, and wherein the first housing is fixed relative to the second housing when the body is locked.

10. The drain cleaner of claim 9, wherein the second housing is rotatable relative to the first housing when the body is unlocked.

11. The drain cleaner of claim 9, wherein the drum release mechanism includes a latch, the latch positioned on the first housing and configured to selectively engage the second housing to lock the body.

12. The drain cleaner of claim 11, wherein the drum release mechanism includes an actuator, the actuator actuable to disengage the latch from the second housing.

13. The drain cleaner of claim 12, wherein the second housing is slidable relative to the first housing while the actuator is being actuated.

14. The drain cleaner of claim 9, wherein the body is unlocked when the second housing is slid away from the first housing.

15. A drain cleaner comprising:

a rotatable drum;

a cable at least partially housed within the drum;

a body supporting the drum, wherein the body includes a first housing and a second housing movable relative to one another between a closed position, in which the drum is secured to the body, and an open position, in which the drum is removable from the body; and a drum release mechanism disposed on one of the first housing and the second housing to selectively lock and unlock the body, wherein the first housing is movable relative to the second housing when the body is unlocked, and wherein the first housing is fixed relative to the second housing when the body is locked, the drum release mechanism including a latch positioned on one of the first housing and the second housing, the latch configured to selectively engage the other of the first housing and the second housing, and an actuator actuable to disengage the latch from the other of the first housing and the second housing, wherein the first housing includes a channel and the second housing includes a projection, the projection being movable in a linear direction within the channel as the second housing moves relative to the first housing.

16. The drain cleaner of claim 15, wherein the second housing is rotatable relative to the first housing when the body is unlocked.

17. The drain cleaner of claim 16, wherein the second housing is slidable relative to the first housing while the actuator is being engaged.

18. The drain cleaner of claim 15, wherein the body is movable to an intermediate position between the closed position and the open position.

* * * * *